US006265817B1

(12) United States Patent
Steinmann et al.

(10) Patent No.: US 6,265,817 B1
(45) Date of Patent: Jul. 24, 2001

(54) ELECTRIC LAMP HAVING A COATED EXTERNAL CURRENT CONDUCTOR

(75) Inventors: Maarten W. Steinmann; Petronella C. M. Baken, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/369,536

(22) Filed: Aug. 6, 1999

(30) Foreign Application Priority Data

Aug. 13, 1998 (EP) ..... 98202716

(51) Int. Cl.[7] ..... H01J 5/50
(52) U.S. Cl. ..... 313/332; 313/626; 313/623
(58) Field of Search ..... 313/623, 626, 313/332, 331, 579

(56) References Cited

U.S. PATENT DOCUMENTS 3,420,944 1/1969 Holcomb ..... 174/17.05
3,926,574 * 12/1975 Priceman ..... 29/197
3,991,337 11/1976 Notelteirs ..... 313/217
4,110,657 * 8/1978 Sobieski ..... 313/332
4,739,219 * 4/1988 Hume ..... 313/623 X
5,200,669 * 4/1993 Dixon et al. ..... 313/623
5,310,374 * 5/1994 Tomoyuki ..... 313/623 X
5,387,839 * 2/1995 Giordano et al. ..... 313/332 X

FOREIGN PATENT DOCUMENTS

0818805 * 1/1988 (EP) .
0375402 * 6/1990 (EP) .
10-172516 * 9/1998 (JP) .

* cited by examiner

*Primary Examiner*—Ashok Patel
(74) *Attorney, Agent, or Firm*—Dicran Halajian

(57) ABSTRACT

The electric lamp comprises a lamp vessel (1) and an electric element (4). The electric element is electrically connected to the exterior via a current feed-through comprising an external current conductor (7). By covering the external current conductor with a protective coating (8) contains chromium which can react with $SiO_2$ to form low-melting phases, the lifetime of the lamp is increased significantly.

3 Claims, 2 Drawing Sheets

ELECTRIC LAMP HAVING A COATED EXTERNAL CURRENT CONDUCTOR

BACKGROUND OF THE INVENTION

The invention relates to an electric lamp comprising:

- a light-transmissive lamp vessel which is closed in a vacuumtight manner and has a quartz glass wall enclosing a space, accommodating an electric element;
- a metal foil completely embedded in the wall and having knife edges formed by knife planes;
- at least an internal current conductor which is connected to the embedded metal foil and projects into the space;
- at least an external current conductor which is connected to the embedded metal foil, projects from the wall of the lamp vessel and is provided with a coating.

A lamp of this type is known from U.S. Pat. No. 3,420,944. During operation of the known lamp, a part of the external current conductor and the metal foil, generally of molybdenum with an additive of, for example, 0.5–1.0% by weight of $Y_2O_3$, has a temperature of more than 450° C. In a lamp in which no measures were taken to inhibit corrosion of the external current conductor and the metal foil, these metal parts would corrode due to the high temperature in so far as the metal parts have an open connection with the atmosphere outside the lamp via a capillary around the external current conductor. Corrosion of the metal foil and/or the external current conductor leads to failure of the lamp due to the interruption of the current supply. The known lamp is protected against corrosion by providing, prior to its manufacture, a chromium coating on the external current conductor and at least parts of the metal foil, the knife edges and the knife planes. At locations where the coating is provided, the protection after manufacture of the lamp has remained intact, but the coating is partly converted into a chromium-containing protective coating. Both the coating and the protective coating retard the corrosion during operation of the lamp.

It is known that, in addition to corrosion of the current feed-through as a cause of premature failure of the lamp, there are various other causes of premature failure. Other causes may be, for example, leakage of the lamp vessel or, for example, an explosion of the lamp. The risk of failure of the lamp due to these other causes has appeared to be small in practice if the lamp has operated for less than a thousand hours.

The corrosion protection of the lamp as is known from U.S. Pat. No. 3,420,944 has the drawback that this leads to such a long lifetime of the lamp, for example, more than a thousand operating hours, that the risk of the lamp failure due to an explosion of the lamp and the risk of follow-up damage are unacceptably greater. The coating has a coating thickness and a quality level determining the corrosion protection and influencing the lifetime of the lamp. However, the quality level and the coating thickness in the known lamp are not controlled to such an extent that a lifetime limitation of a thousand operating hours is adjustable, which leads to an unacceptably large spread of the lamplife.

Another drawback of the known lamp is that the coating must be provided on the metal foil. Due to the extra treatments with the vulnerable metal foil, there is a great risk that the knife edges of the metal foil are damaged. The damaged knife edges of the metal foil embedded in the finished lamp lead to high tensions in the wall of the lamp vessel so that the risk of failure during manufacture of the lamp or due to premature leakage of the lamp vessel will be unacceptably greater.

SUMMARY OF THE INVENTION

It is an object of the invention to provide an electric lamp, having a simple construction which can easily be made and obviates the above-mentioned drawbacks.

According to the invention, this object is achieved in that a protective coating is present on the metal foil and on the external current conductor, the protective coating comprising a low melting point reaction product of the coating with $SiO_2$, and at least the knife planes being free from the protective coating. In the manufacture of the lamp, a seal is made in which one or more of said metal foils are enclosed in the wall. During this operation, the quartz glass is softened at the area where this seal is to be created in the presence of the metal foil and the external current conductor. The quartz glass then reaches a temperature of more than 1900° C. As soon as the quartz glass comes into contact with the external current conductor, this conductor and the coating provided thereon become so hot that the coating melts and flows out on the quartz glass and parts of the metal foil. The molten coating reacts substantially immediately and forms relatively low melting point reaction products with the molybdenum of the external current conductor and the metal foil, and with the quartz glass. Subsequently, the seal thus formed is cooled down. Owing to its comparatively high coefficient of linear thermal expansion (approximately $50*10^{-7}K^{-1}$), the external current conductor contracts more strongly than the quartz glass, glass having an $SiO_2$ content of at least 95% by weight (linear thermal expansion coefficient of approximately $6*10^{-7}K^{-1}$) in which it is embedded. This creates a capillary space around this current conductor. No such capillary space is created around the metal foil because of the foil shape.

After some cooling, the capillary space has formed around the external current conductor but the low melting point reaction products are still fluid for some time. Due to capillary action, the low melting point reaction products mainly contract in corners and narrow portions of the capillary space, with a large, substantially cylindrical hollow space remaining behind in the capillary. The hollow space has an open connection with the atmosphere outside the lamp. The capillary-adjacent parts of the quartz glass, the external current conductor and the metal foil are, however, shielded from the atmosphere outside the lamp in that the low melting point reaction products have remained behind as a thin protective coating on the parts adjacent the capillary, which protective coating is relatively thick in the corners and the narrow portions of the capillary. The knife planes, preferably at least up to a distance of the knife edges having a largest thickness D of the metal foil, and the knife edges have remained free from the protective coating.

Corrosion of the external current conductor and/or the metal foil results in an expansion and is most critical in the corners of the capillary. In the corners of the capillary, this expansion soon leads to high tensile stresses in the quartz glass because the capillary in the corners has little room for this expansion. Thus there is a great risk of breakage in the quartz glass, starting in one of the corners of the capillary. If corrosion of the metal foil and the external current conductor occurs near one of the corners of the capillary, the accompanying expansion has a wedge effect. Due to the acute angles at which the quartz glass engages the metal foil, the tension building up in the quartz glass as a result of the expansion will concentrate near the acute angles of the capillary in the quartz glass. The risk of breakage in the quartz glass, starting at one of the angles of the capillary, is thereby further increased. Since a relatively thick protective coating has come in the lamp according to the invention, notably in the corners, these corners are well protected against corrosion and there is a small risk that the above-mentioned phenomena occur too quickly. However, corrosion of the metal foil and the external current conductor still occurs. It has been found that the moment of failure, for example at a lifetime of 800–1000 operating hours, has become satisfactorily adjustable in the lamp according to the invention by varying the coating thickness of the coating. This is in contrast to the known lamp in which it has been found that the quality level and the coating thickness cannot be controlled to such an extent that a lifetime limitation of a thousand operating hours is adjustable, resulting in an unacceptably large spread of the lamp lifetime.

As a result of this corrosion protection, an acceptable long lifetime of the lamp is achieved with a negligibly small risk of explosion of the lamp, for example 800 hours at a temperature of approximately 460° C. of a part of the external conductor and the metal foil during operation of the lamp.

In a favorable embodiment, the protective coating comprises chromium. An advantage which chromium appears to have is that it is very effective as a protective coating on current feed-throughs of molybdenum and tungsten in quartz glass, forming relatively low melting point reaction products low compared to Mo and W with these materials. Chromium metal melts at a temperature of 1890° C. Hence, when making a feed-through, said phenomena occur. Chromium reacts with oxygen to Cr oxide, which oxygen is obtained from the quartz glass while forming SiO and/or Si. The Cr oxide forms low melting point reaction products such as Cr/Si oxide and/or a Cr/Mo alloy and/or a Cr/Si/Mo phase by reactions with metal parts adjacent the capillary, for example with the molybdenum metal foil and with the quartz glass, for example SiO and/or Si. These relatively low melting point reaction products appear to be effective as a protective coating.

In a preferred embodiment of a lamp, the coating has a thickness of 4–6 $\mu$m. The thickness of the coating is a parameter which also determines the extent of corrosion protection. To obtain a corrosion protection in which the critical areas in the capillary are shielded to a satisfactory extent, it has been found that a thickness of 4–6 $\mu$m of the coating is favorable. If the thickness is less than 4 $\mu$m, the protective coating obtained is too thin and the corrosion protection is insufficient. The lamp then has an unacceptably short lifetime. At a thickness of more than 6 $\mu$m, there is superfluous use of material and the lamp has such a long lifetime that there is an unacceptably great risk of explosion of the lamp.

U.S. Pat. No. 3,991,337 discloses a lamp in which it has been attempted to prevent corrosion of the external current conductor. To this end, a coating of nickel, palladium, indium, gold or platinum is provided on the external current conductor. Such coatings do not form low melting point reaction products with $SiO_2$ during manufacture of the lamp. If the coating in such a lamp is provided on the external current conductor but not on the metal foil, the external current conductor is protected against corrosion but the metal foil, some parts of which have an open connection via the capillary with the atmosphere outside the lamp, is not. It has been found that the known lamp has the drawback of an unacceptably short lifetime owing to corrosion of the metal foil, which leads to interruption of the current to the electric element so that the lamp no longer ignites.

These and other aspects of the invention are apparent from and will be elucidated with reference to the embodiments described hereinafter.

BRIEF DESCRIPTION OF THE DRAWINGS

FIGS. 2–2A show details of a seal of the lamp of FIG. 1;

DETAIL DESCRIPTION OF THE PREFERRED EMBODIMENTS

Figure 1:
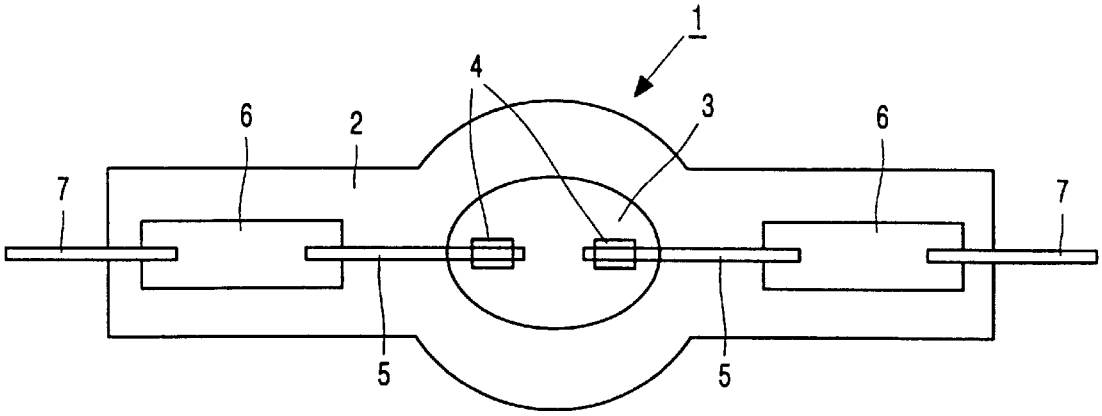
FIG. 1 shows a lamp according to the invention in a plan view.

In FIG. 1, the electric lamp is a high-pressure gas discharge lamp having a lamp vessel 1 which is closed in a vacuumtight manner and a quartz glass wall 2 enclosing a space 3. The electric element 4, a few electrodes in the Figure, is connected via a respective internal current conductor 5 to a respective one of the metal foils 6, of Mo with 0.5% by weight of $Y_2O_3$ in the Figure, and project from the wall 2 of the lamp vessel 1 into the space 3. The metal foils 6 are embedded in the wall 2 of the lamp vessel 1 and connected, for example welded, to a respective external current conductor 7, of Mo in the Figure.

The internal current conductors 5 and the electric element 4 are made of tungsten and may have a small amount of crystal growth of tungsten-regulating means such as 0.01% by weight in total of K, Al and Si, and as an additive 1.5% by weight of $ThO_2$. An ionizable filling is present in the space 3. In the Figure, the lamp vessel 1 is filled with mercury, rare gas and halides of dysprosium, holmium, gadolinium, neodymium and cesium. The lamp shown in the Figure consumes a power of 700 W during operation. Under atmospheric circumstances, the lamp may operate without an outer envelope without such a corrosion of the metal foil 6 and the external current conductor 7 occurring that the lamp fails out prematurely.

Figure 2:
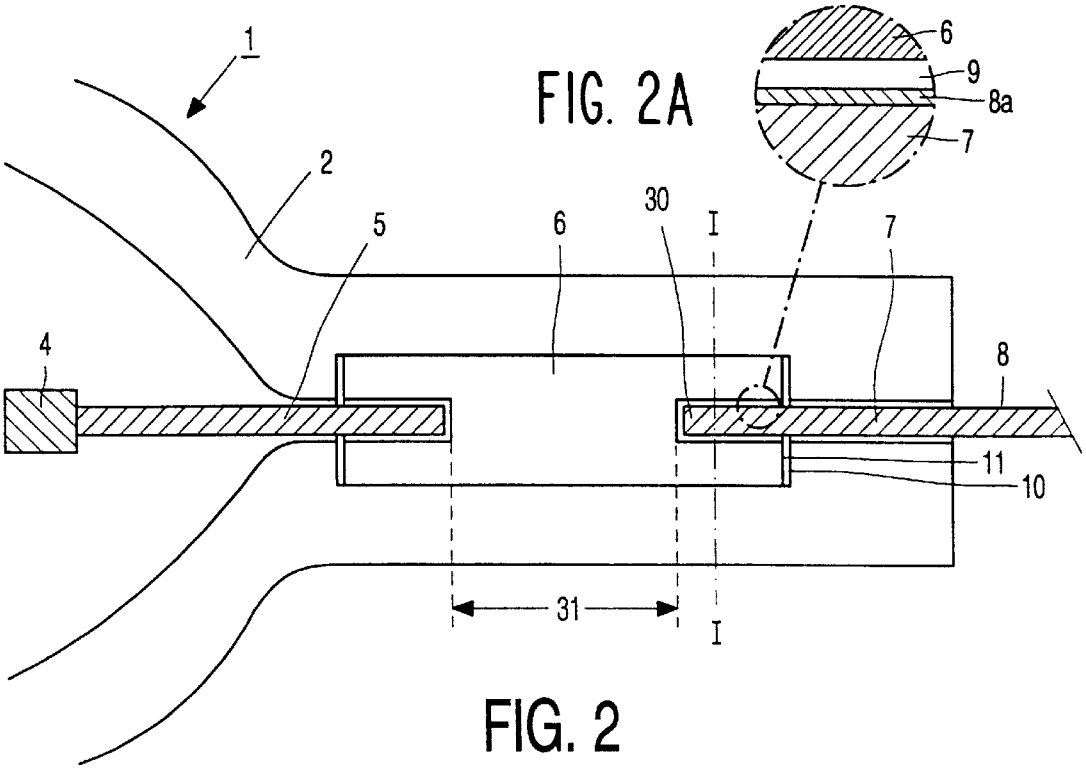

FIGS. 2–2A show that the external current conductors 7 have a protective coating 8*a*, Cr-containing phases in the Figure, which shields the external current conductors 7 and a capillary 9 around the external current conductors 7 from each other, said protective coating 8*a* gradually changing over to a coating 8 provided on that part of the external current conductor 7 which projects from the wall 2. It has been indicated that the capillary 9 terminates at an end 30 of the external current conductor 7. It has further been indicated that a capillary 10 is present at a head end 11 of the metal foils 6. The capillaries 9 and 10 are in open connection with the atmosphere outside the lamp, the protective coating 8*a* and the coating 8, preventing a too rapid corrosion of the metal foil 6 and the external current conductor 7. The seal is vacuumtight at the area of the metal foil 6 in a zone 31 between the external current conductor 7 and the internal current conductor 5.

Figure 3:
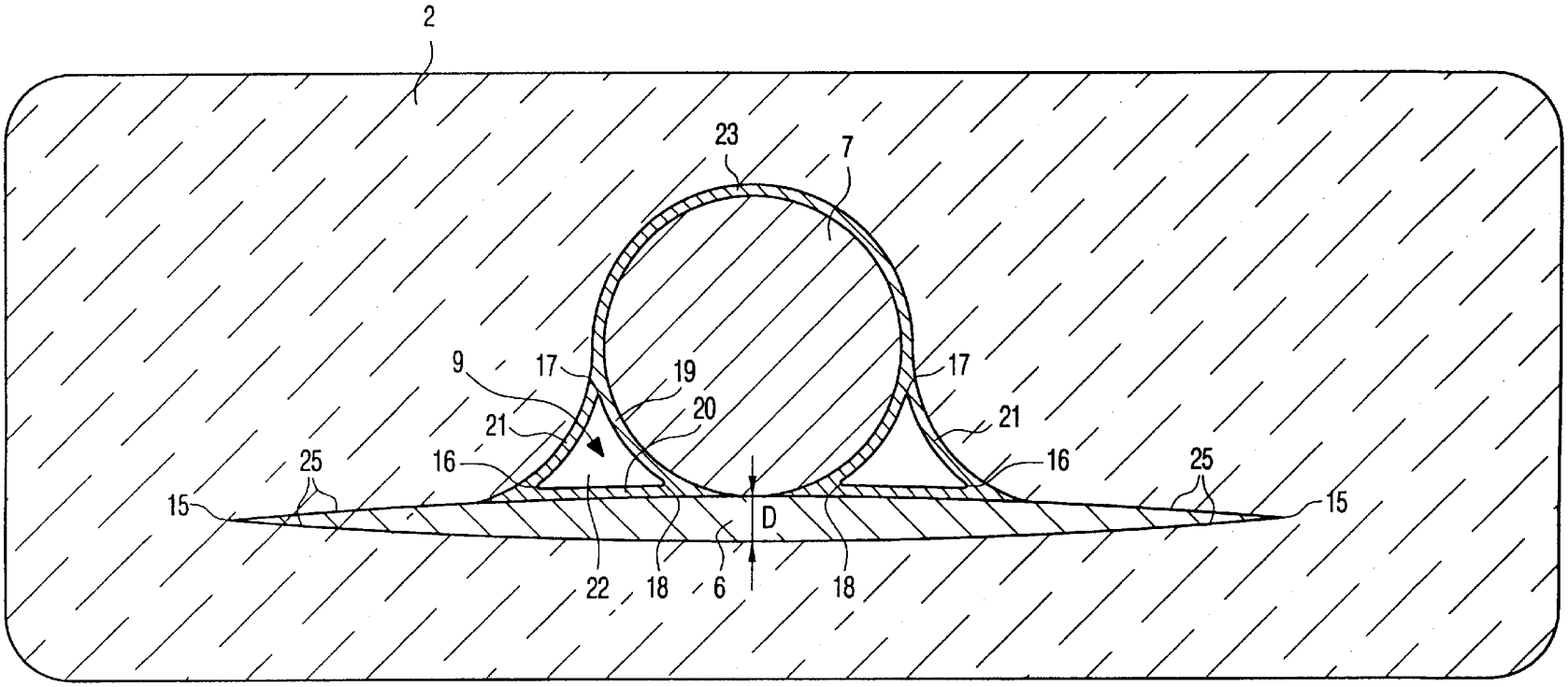
FIG. 3 is a cross-section taken on the line I—I of a seal of the lamp shown in FIG. 1.

FIG. 3 is a cross-section of the seal shown in FIGS. 2–2A, taken on the line I—I. The Figure shows that the metal foil 6 has a largest thickness D. There is no capillary at the knife edges 15 formed by the knife planes 25 of the metal foil 6. The capillary 9 around the external current conductor 5 has a hollow space 22 which communicates with the atmosphere outside the lamp. The capillary 9 is partly filled with relatively low melting point reaction products, for example a Cr/Mo alloy, a Cr/Si oxide and a Cr/Mo/Si phase which has formed the Cr coating with Mo and/or $Sio_2$ during the operation of creating the seal. The low melting point Cr/Si oxide and Cr/Mo/Si phase are notably present in the corners 16 and 17 in the capillary 9 and in the narrow part 23 of the capillary 9 around the external current conductor 7 and remote from the metal foil 6. The low melting point Cr/Mo alloy is notably present in the narrow part 18 and as thin coatings 19 and 20 on the parts of the external current conductor 7 and the metal foil 6 facing the hollow space 22 and adjacent the capillary. The knife edges 15 and the knife planes 25 have remained free from the protective coating 8*a*. A relatively thin film of low melting point reaction product 21 of Cr/Si oxide is present on the surface of the quartz glass wall 2 facing the hollow space 22.

Notably the comers 16, 17 and 18 are critical areas as far as corrosion of the metal foil 6 and the external current conductor 7 is concerned. At these areas, there is no possibility of expansion in the hollow space 22 due to corrosion. A small expansion of the metal foil 6 and/or the external current conductor 7 in the comers 16, 17 and 18 thus results in high tensile stresses in the wall 2. Moreover, the corrosion of the metal foil 6 and the external current conductor 7 and the accompanying expansion have a wedge effect due to the acute angles at which the quartz glass engages the metal foil 6 and the external current conductor 7. Since a relatively thick protective coating 8*a* has notably come in the corners 16 and 17 and the narrow parts 18 and 23 of the capillary, a satisfactory corrosion protection of the metal foil 6 and the external current conductor 7 is achieved at these areas.

In the embodiment shown, the external current conductor 7 has a thickness of approximately 1 mm. The coating 8 has a thickness of approximately 4.5 $\mu$m.

What is claimed is:

1. An electric lamp comprising:

a light-transmissive lamp vessel (1) which is closed in a vacuumtight manner and has a quartz glass wall (2) enclosing a space (3), said lamp vessel accommodating an electric element (4);

a metal foil (6) completely embedded in the wall and having knife edges (15) formed by knife planes (25);

at least an internal current conductor (5) which is connected to the embedded metal foil and projects into the space;

at least an external current conductor (7) which is connected to the embedded metal foil, projects from the wall of the lamp vessel and is provided with a coating (8); and a protective coating (8*a*) on the metal foil and on the external current conductor, the protective coating comprising chromium and at least one reaction product of the chromium and at least one of the metal foil, the external current conductor, and the quartz glass, at least the knife planes being free from the protective coating.

2. A lamp as claimed in claim 1 wherein the coating (8) has a thickness of 4–6 $\mu$m.

3. A lamp as in claim 1, wherein at least one of the metal foil and the external current conductor is molybdenum, and the reaction product is at least one of Cr/Mo alloy, Cr/Si oxide, Cr/Mo/Si phase, SiO, and Si.

* * * * *